US006670537B2

(12) United States Patent
Hughes et al.

(10) Patent No.: US 6,670,537 B2
(45) Date of Patent: Dec. 30, 2003

(54) MEDIA PLAYER FOR DISTRIBUTION OF MUSIC SAMPLES

(75) Inventors: David A. Hughes, New York, NY (US); Matthew A. Carpenter, New York, NY (US); Mandana Massiha, New York, NY (US); Phuong L. Nguyen, Wayne, NJ (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/838,967

(22) Filed: Apr. 20, 2001

(65) Prior Publication Data

US 2002/0152876 A1 Oct. 24, 2002

(51) Int. Cl.[7] ..... A63H 5/00; G04B 13/00; G10H 7/00

(52) U.S. Cl. ..... 84/609; 705/26

(58) Field of Search ..... 84/609–614, 634–638, 84/645, 477 R, 478; 434/307 A; 707/104; 705/26, 27

(56) References Cited

U.S. PATENT DOCUMENTS

| | | | | |
|---|---|---|---|---|
| 5,340,939 A | | 8/1994 | Kumagai | |
| 5,734,118 A | | 3/1998 | Ashour et al. | |
| 5,890,910 A | * | 4/1999 | Tsurumi et al. | 84/609 X |
| 5,918,213 A | * | 6/1999 | Bernard et al. | 705/26 |
| 5,947,746 A | * | 9/1999 | Tsai | 84/609 X |
| 5,953,005 A | * | 9/1999 | Liu | 434/307 X |
| 6,093,880 A | * | 7/2000 | Arnalds | 84/645 X |
| 6,225,545 B1 | * | 5/2001 | Suzuki et al. | 84/477 R |
| 6,229,769 B1 | | 5/2001 | Packer | |
| 6,248,946 B1 | * | 6/2001 | Dwek | 84/609 |
| 6,256,623 B1 | * | 7/2001 | Jones | 707/104 X |
| 6,263,313 B1 | * | 7/2001 | Milsted et al. | 84/609 X |
| 6,288,319 B1 | * | 9/2001 | Catona | 84/609 |
| 6,297,439 B1 | * | 10/2001 | Browne | 84/635 |
| 6,405,225 B1 | * | 6/2002 | Apfel et al. | 715/526 |
| 6,549,612 B2 | * | 4/2003 | Gifford et al. | 379/67.1 |
| 2002/0082901 A1 | * | 6/2002 | Dunning et al. | 705/10 |

FOREIGN PATENT DOCUMENTS

| | | | | |
|---|---|---|---|---|
| EP | 649121 A2 | * | 4/1995 | 84/609 |

* cited by examiner

*Primary Examiner*—Jeffrey Donels
(74) *Attorney, Agent, or Firm*—Miller Patent Services; Jerry A. Miller

(57) ABSTRACT

A method and apparatus of music distribution from a media player. A media player is provided with a "send to friend" icon. In one embodiment, when the icon is selected, a clipping of the currently playing music selection is taken from a predetermined location in the music selection and compressed using a fidelity reducing compression technique to produce a sample of the current selection suitable for distribution. The compressed clipping is sent to a selected recipient or recipients by email in the background while the music selection continues to play. The recipient(s) can be either a default recipient(s) or a recipient(s) selected from a list as in an address book application.

41 Claims, 14 Drawing Sheets

430

430

430

430

430

MEDIA PLAYER FOR DISTRIBUTION OF MUSIC SAMPLES

FIELD OF THE INVENTION

This invention relates generally to the field of electronic distribution of audio (or video) recordings. More particularly, this invention relates to a so-called super distribution techniques.

BACKGROUND OF THE INVENTION

In recent years, providing samples of a musical selection has become a popular marketing tool for record companies as well as other organizations marketing music. By creating electronic samples of a computer readable music file, the samples can be distributed as a marketing tool according to various electronic schemes often referred to as super distribution. Unfortunately, current software applications do not provide a convenient mechanism for a user to distribute such music samples. This limits the effectiveness of certain super distribution techniques.

SUMMARY OF THE INVENTION

The present invention relates generally to electronic distribution of audio and other content. Objects, advantages and features of the invention will become apparent to those skilled in the art upon consideration of the following detailed description of the invention.

A method of transmitting an audio sample, consistent with an embodiment of the invention includes, within a media player application program, playing an audio selection; upon receipt of a command from a user, launching an email application from within the media player; generating an email message; attaching a sample of the audio selection to the email; and sending the email and the attached audio sample to a recipient.

A media player, consistent with an embodiment of the present invention includes a programmed processor with a media player application running on the programmed processor to enable a user to play content. A user interface for the media player includes an icon or other control mechanism, that when selected causes the media player application to launch an email application and send a sample of the content from a sender to a recipient.

An electronic storage medium consistent with an embodiment of the invention contains instructions which, when executed on a programmed processor, carry out a method of transmitting a content sample from within the media player, by playing a content selection; upon receipt of a command from a user, launching an email application from within the media player; generating an email message; attaching a sample of the content selection to the email; and sending the email and the attached content sample to a recipient.

Embodiments of the present invention provide a method and apparatus of music distribution from a media player. A media player is provided with a "send to friend" icon. In one embodiment, when the icon is selected, a clipping of the currently playing music selection is taken from a predetermined location in the music selection and compressed using a fidelity reducing compression technique to produce a sample of the current selection suitable for distribution. The compressed clipping is sent to a selected recipient or recipients by email in the background while the music selection continues to play. The recipient(s) can be either a default recipient(s) or a recipient(s) selected from a list as in an address book application.

The above summaries are intended to illustrate exemplary embodiments of the invention, which will be best understood in conjunction with the detailed description to follow, and are not intended to limit the scope of the appended claims.

BRIEF DESCRIPTION OF THE DRAWINGS

The features of the invention believed to be novel are set forth with particularity in the appended claims. The invention itself however, both as to organization and method of operation, together with objects and advantages thereof, may be best understood by reference to the following detailed description of the invention, which describes certain exemplary embodiments of the invention, taken in conjunction with the accompanying drawings in which:

DETAILED DESCRIPTION OF THE INVENTION

Figure 1:
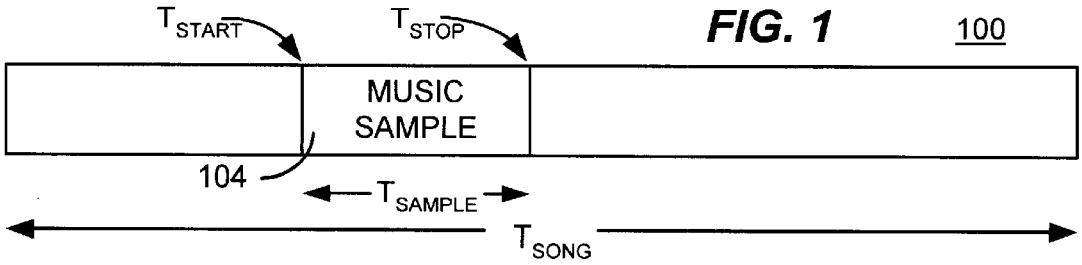
FIG. 1 illustrates a music or other audio sample within a digital music file.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawings.

Referring now to FIG. 1, a music file, or other audio file, is generally represented as 100. The music file can be viewed as a linear file of data extending from left to right as time increases in FIG. 1. When streamed from a server or disc drive or the like, the music file 100 will play for a time duration shown as $T_{SONG}$. The desired music sample including the so-called "hook" (i.e., a memorable passage of the music that is likely to attract a potential buyer's attention), can be represented as a segment of the file shown as "music sample" 104 starting at times $T_{START}$ and ending at time $T_{STOP}$. Depending on the individual music selection and also dependent in general upon the particular genre of music, the start of the hook is generally located somewhere around 45 to 60 seconds into a typical 3 minute popular music selection. With other genres of music, such as jazz or classical music, the hook might appear significantly later or earlier. Additionally, for example, 1950s rock and roll hooks typically occur somewhat sooner. Thus, the start time for the sample may range from about 30 to about 60 seconds.

Generally speaking, current mass marketed music that may benefit most from the music sampling described herein falls within the category of popular music. In this case, the hook typically starts, as previously noted, between 45 and 60 seconds into the selection. Thus, a music sample of approximately 30 seconds can be generated by simply taking a clipping from the original music file starting at approximately 45 to 60 seconds (or slightly earlier, e.g., 5 to 15 seconds earlier) and lasting for a duration of approximately 30 seconds. For jazz or classical selections, it is beneficial to take a longer music selection of perhaps 45 to 60 seconds since a 30 second clip may not present a representative sample of the music selection.

Figure 2:
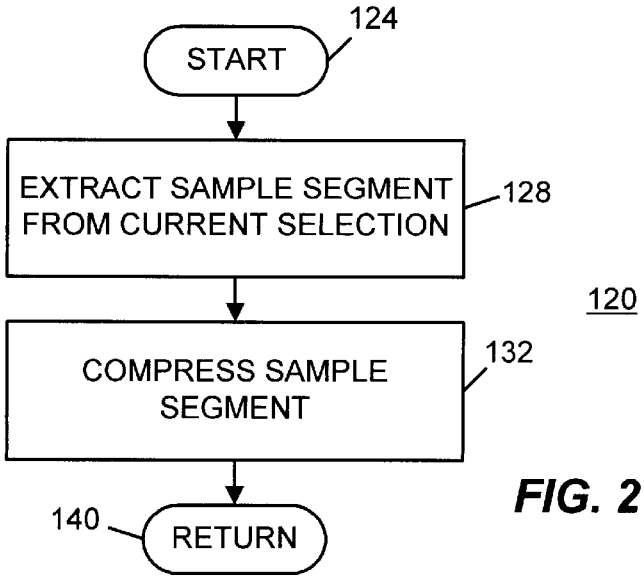
FIG. 2 is a high level flow chart of a music clipping process consistent with embodiments of the present invention.

Referring now to FIG. 2, an overall process for creating a music clipping suitable for super distribution is illustrated as process 120 that starts at 124. Generally the music sample is extracted as a segment of the music selection file 100 at 128. At 132 the selected sample segment is compressed using any suitable compression technique to reduce the file size. Any suitable compression technique can be utilized for this purpose including lossy compression techniques and reduction of the data rate (the streaming data rate) associated with the music selection. In general, although such compression degrades the fidelity of the resulting sample segment, it is more desirable to degrade the sample quality somewhat then to have a resulting sample file that is large and thus more difficult to readily distribute (for example, over the Internet). At 140 the process terminates to return a music clipping for use. This process can be carried out by the end user, retail establishment, record company, publicist, marketing concern, artist or other private or commercial entity interested in promoting the audio selection.

Figure 3:
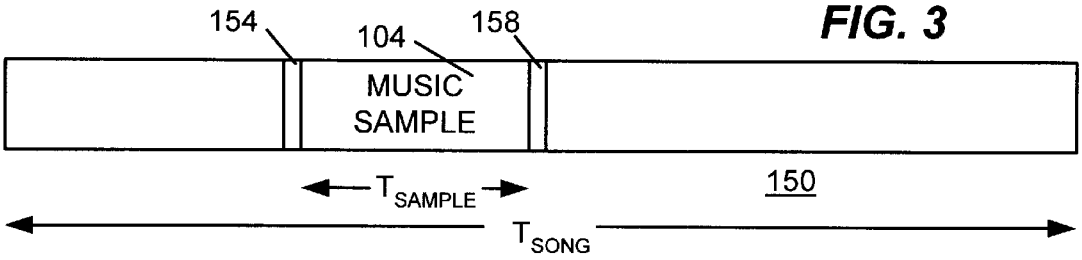
FIG. 3 illustrates a music sample within a digital audio file using start and stop flags.

In accordance with the embodiment illustrated in FIG. 1, a fixed starting time is defined (e.g., 45 seconds from the start of the music selection) for extracting the music sample and the sample duration $T_{SAMPLE}$ is also predefined (e.g., 30 seconds) to create a generally applicable music clipping. However, other techniques can also be utilized to perform the initial extraction of the sample segment (i.e. 128 of FIG. 2). FIG. 3 illustrates a second technique for creating a music sample (or other audio or video sample) consistent with the embodiment of the present invention. In this embodiment, the sample is defined in the production and manufacturing process. In this technique, a preferred music sample 104 is preceded by a start flag shown as 154 and may also be followed by a stop flag shown as 158. Alternatively, only a start flag 154 may be used in conjunction with a predefined sample time defining the stopping point. In this embodiment, the sample can be automatically extracted from the file 150 by simply scanning the file for the location of start flag 154 and possible stop flag 158. Such flags can be readily embedded in a music file and can be ignored by the music file playing or, if interpreted by the player as music data, these flags are of such short duration as to be unlikely to be noticed by the human ear. The recorded audio along with start and stop flags can be recorded on any suitable electronic storage medium such as a compact disc.

A third technique for extracting a sample segment as in 128 of FIG. 2 is illustrated in connection with the use of file 170 of FIG. 4. In this example, the music file 170 (or other audio or video file) includes a header 174 containing data relating to the music file 170. A portion of this data in header 174 can be defined to be either a starting packet number or starting time associated with the music sample as well as possibly an ending packet number or ending time associated with the music sample. Alternatively, a sample duration could be specified. The recorded audio along with start and stop flags can be recorded on any suitable electronic storage medium such as a compact disc. Many variations of these techniques will occur to those skilled in the art and can be adapted for use with video as well as audio.

Figure 5:
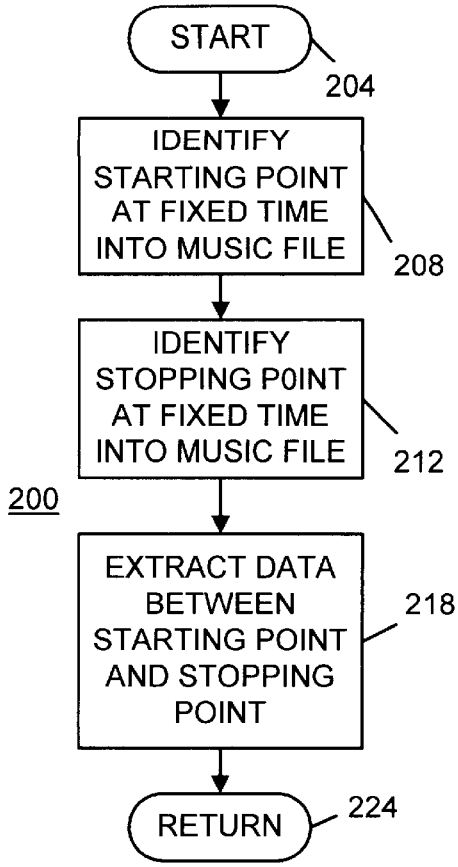
FIG. 5 is a flow chart of an embodiment of a sampling technique consistent with certain embodiments of the invention.

Referring now to FIG. 5, a process for deriving a music sample as illustrated in FIG. 1 is shown as process 200. The process starts at 204. At 208, a starting point $T_{START}$ is identified as a fixed time from the beginning of the music file. At 212, a stopping point $T_{STOP}$ is identified as a fixed time into the audio file or equivalently a fixed time at $T_{START}$ At 218, the data between the starting point $T_{START}$ and the stopping point $T_{STOP}$ is extracted to define the segment of music to be used in creation of the sample. The process then returns at 224. Of course, those skilled in the art will appreciate that the extraction of the data may begin as soon as the starting point is identified. The extraction can then proceed until the sample time has expired or until the stopping point $T_{STOP}$ is encountered.

Figure 4:
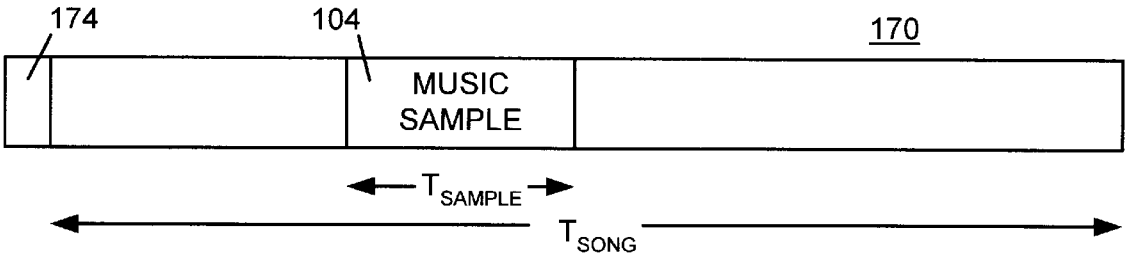
FIG. 4 illustrates a music sample within a digital audio file using a header to define a sample.
Figure 6:
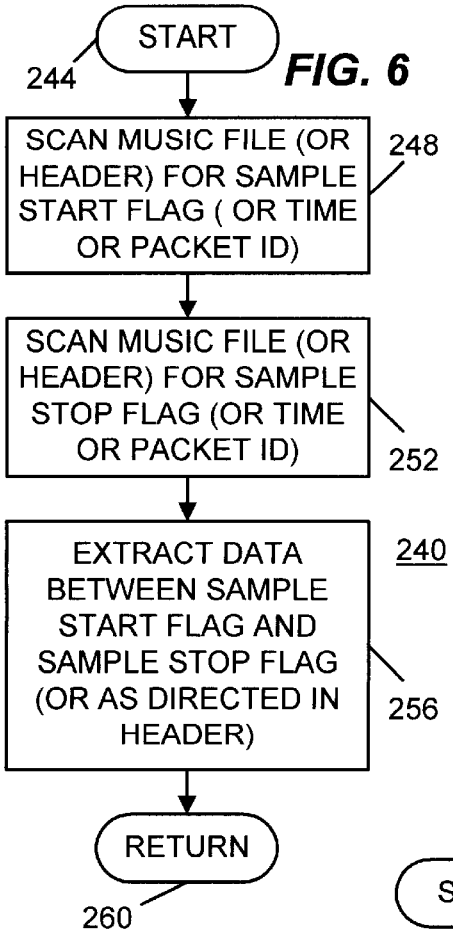
FIG. 6 is a flow chart of another embodiment of a sampling technique consistent with certain embodiments of the invention.

Referring now to FIG. 6, a process 240 starting at 244 describes the processes for extracting a sample segment from file 150 of FIG. 3 in file 170 of FIG. 4. At 248 the header 174 is scanned for a sample start flag for starting time or starting packet identifier. At 252 the music file or header is scanned for the sample stop flag (or time or packet ID.) At 256 the data between the sample start and sample stop indicators (flag, time or packet ID) to define the sample segment to be used for ultimate creation of music clippings. The process returns at 260. Of course, those skilled in the art will appreciate that the extraction of the data may begin as soon as the starting point is identified. The extraction can then proceed until the sample time has expired or until the stopping point $T_{STOP}$ is encountered.

Figure 7:
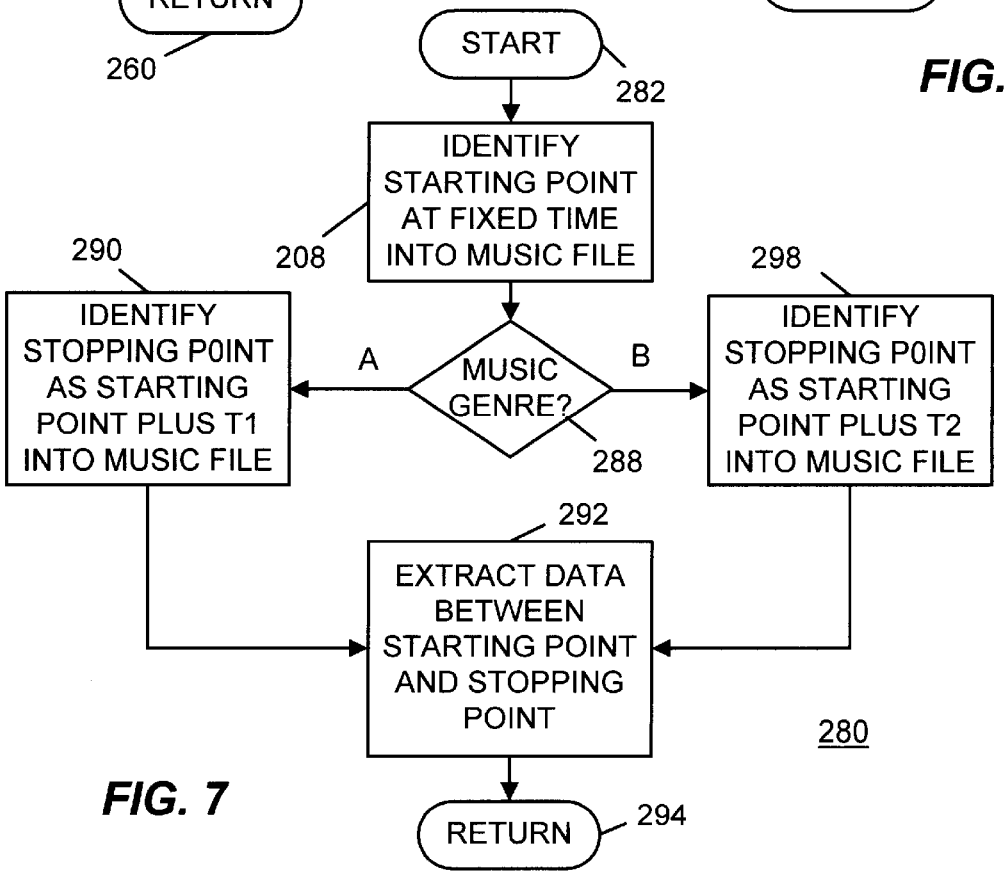
FIG. 7 is a flow chart of a third embodiment of a sampling technique consistent with certain embodiments of the invention.

Referring now to FIG. 7, a variation of process 200 of FIG. 5 is illustrated starting at 282. At 208, the starting point is identified as a fixed time from the beginning of the music selection. Control then passes to 288 where the music genre is identified. This can be accomplished by data supplied in a header such as header 174, by user selection or any other suitable mechanism. In the case of genre A, control passes to 290 where a stopping point is identified as the starting point plus a fixed time T1 into the music file. Control then passes to 292 where the data is extracted between the starting point and stopping point to provide the sample segment from the current music selection and the process returns at 294. However, if the music genre is determined to be B at 288, control passes to 298 where the stopping point is identified as the starting point plus a different time T2 into the music file. Control then passes to 292 as previously. In accordance with this embodiment, multiple types of music can be sampled to generate a more suitable sample based upon the type of music being sampled. Thus, genre A may be considered popular music while genre B may be classical music with T1 equaling 30 seconds and T2 equaling 60 seconds. While the process 280 is illustrated as having only two selections A and B, those skilled in the art will appreciate that any number of such selections are possible and can be defined to most closely match an appropriate time period for the selection of the sample based upon the particular type of music, audio video or other program material.

Samples created in accordance with any of the processes described above can be carried out by the end user, retail establishment, record company, publicist, marketing concern, artist or other private or commercial entity interested in promoting the audio selection.

The process just described can be implemented as a computer program or script operating as a portion of, for example, a computer media player. However, many other implementations are possible without departing from the present invention. In one alternative embodiment, an email enabled personal audio player can embody the functionality of the present invention, with email facilities provided via wireless or wired communication. The compressed music sample previously described can be generated as part of a media player in one embodiment of the invention so that a user can advantageously produce a music sample of a currently playing music selection and with a single click of a computer screen icon, push of a button or other interface, initiate a process for sending that music sample to a friend (or potential customer).

Figure 8:
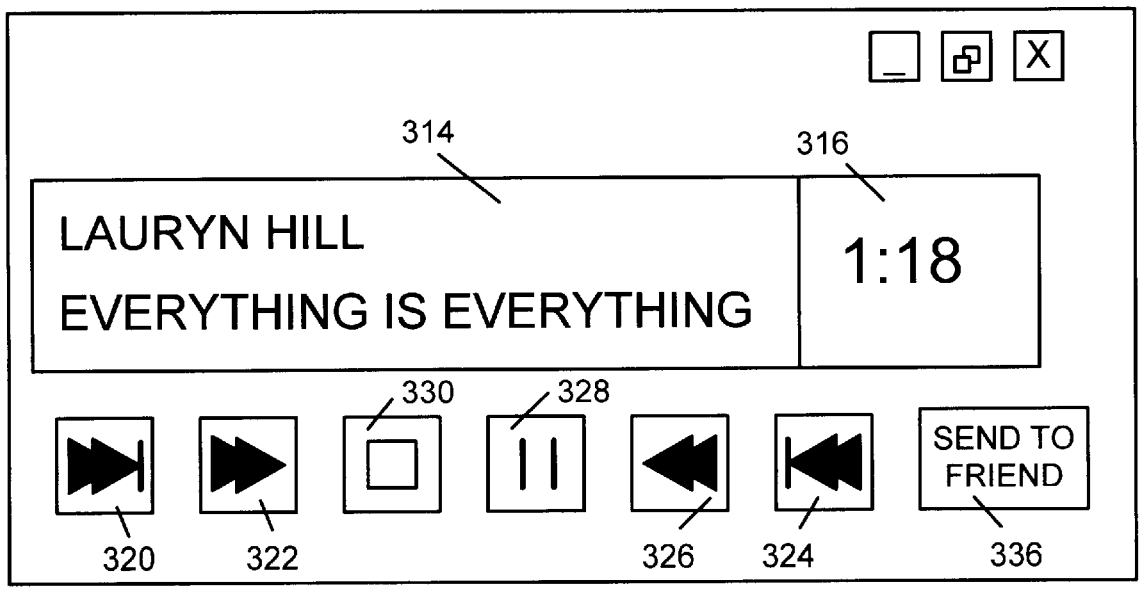
FIG. 8 illustrates an exemplary embodiment of a user interface of a media player that can employ a music clipping process according to embodiments of the present invention.

FIG. 8 shows a simplified user interface for a media player 310. Media players similar to those provided by Microsoft, Real Networks as well as ATI and other corporations can be modified to provide this function. In the illustrative interface 310 shown in FIG. 8, a display window 314 displays the artist and the name of the selection being played for an audio selection. Other media players can also play video selections, and the present invention can be used with such media players for sending video samples. The present invention can be generally applied to any such content. Window 316 displays the elapsed time in this selection. Various play control buttons are provided such as search forward button 320, scan forward button 322, search backwards button 324, scan backwards button 326, pause button 328 and start/stop button 330 in a familiar arrangement. In addition, the interface includes a button labeled as "send to friend" button 336. In other embodiments an icon such as an email envelope icon or the like can be also utilized. In this embodiment, the media player can send a sample of the currently playing selection to a friend, acquaintance or potential purchaser by use of the button 336. Those skilled in the art will appreciate that other user interfaces could also be used without departing from the invention.

Figure 9:
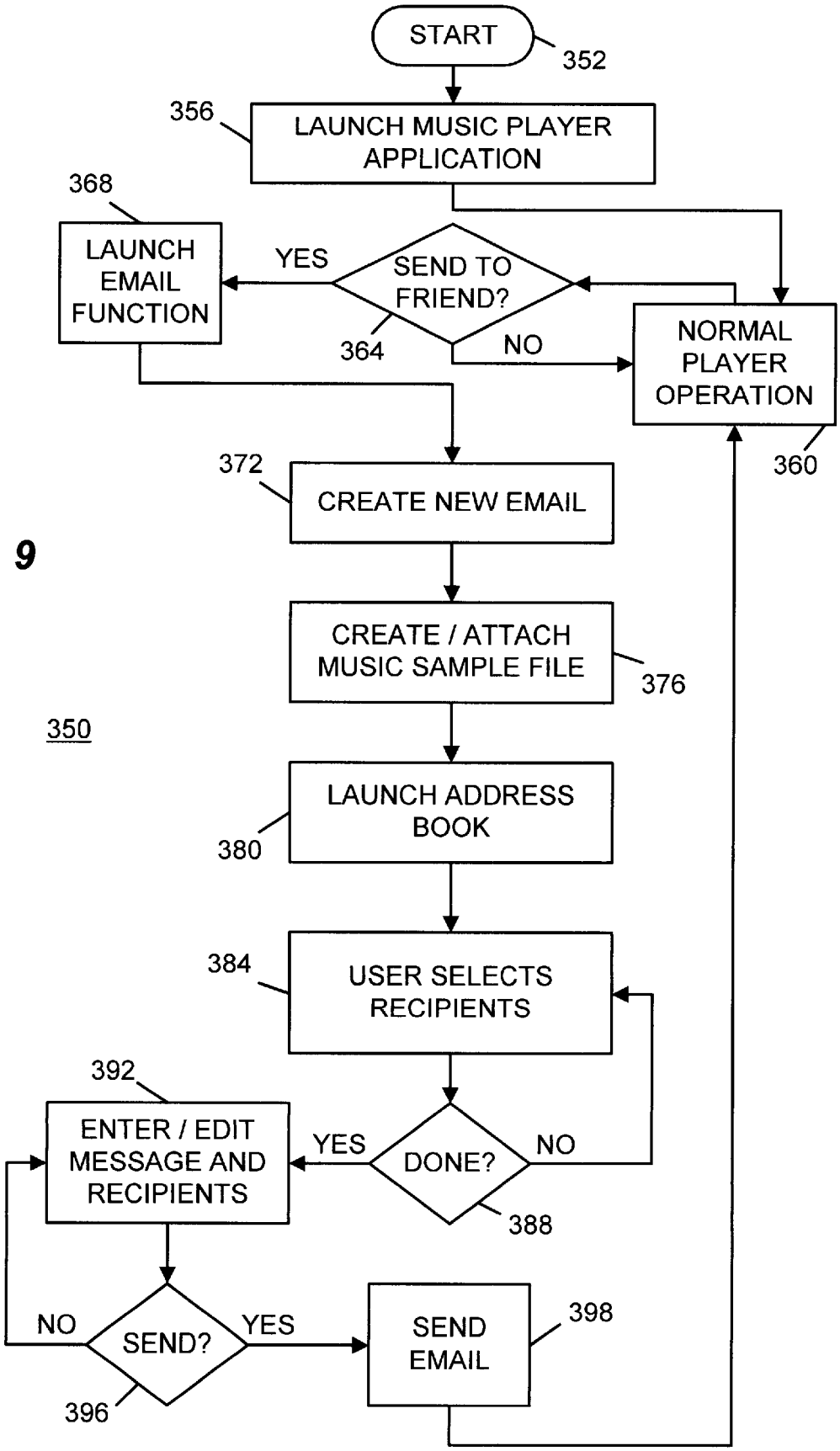
FIG. 9 is a flow chart illustrating a music clipping and distribution process consistent with certain embodiments of the present invention.

FIG. 9 illustrates a process 350 starting at 352 for utilizing the media player 310 to send an email music sample to a friend or other recipient. At 356 the music player application associated with interface 310 of FIG. 8 is launched and proceeds to normal player operation at 360. The media player at 360 operates in a normal fashion under control of the user to play compact discs, .MP3 files, .AAC files, .WMA files or other recorded media in a conventional manner until such time as the user operates the "send to friend" control 336 as detected at 364. When this occurs, an email application is launched at 368, which automatically creates a new email message at 372. Control then passes to 376 where a music sample file is attached (if it currently exists) or is created according to one of the processes previously described (or any other suitable process) and then attached to the new email. Control then passes to 380 where an address book function is launched so that the user can select recipients at 384. The user continues to select recipients for the email at 384 until completed at 388 at which point the user is passed to a conventional email edit screen wherein a new message can be created or edited at 392. The email functions just described can be carried out using an adaptation of software programs such as Microsoft Outlook™, Microsoft Outlook Express™ or Lotus Notes™ as well as other email programs commercially available.

Figure 10:
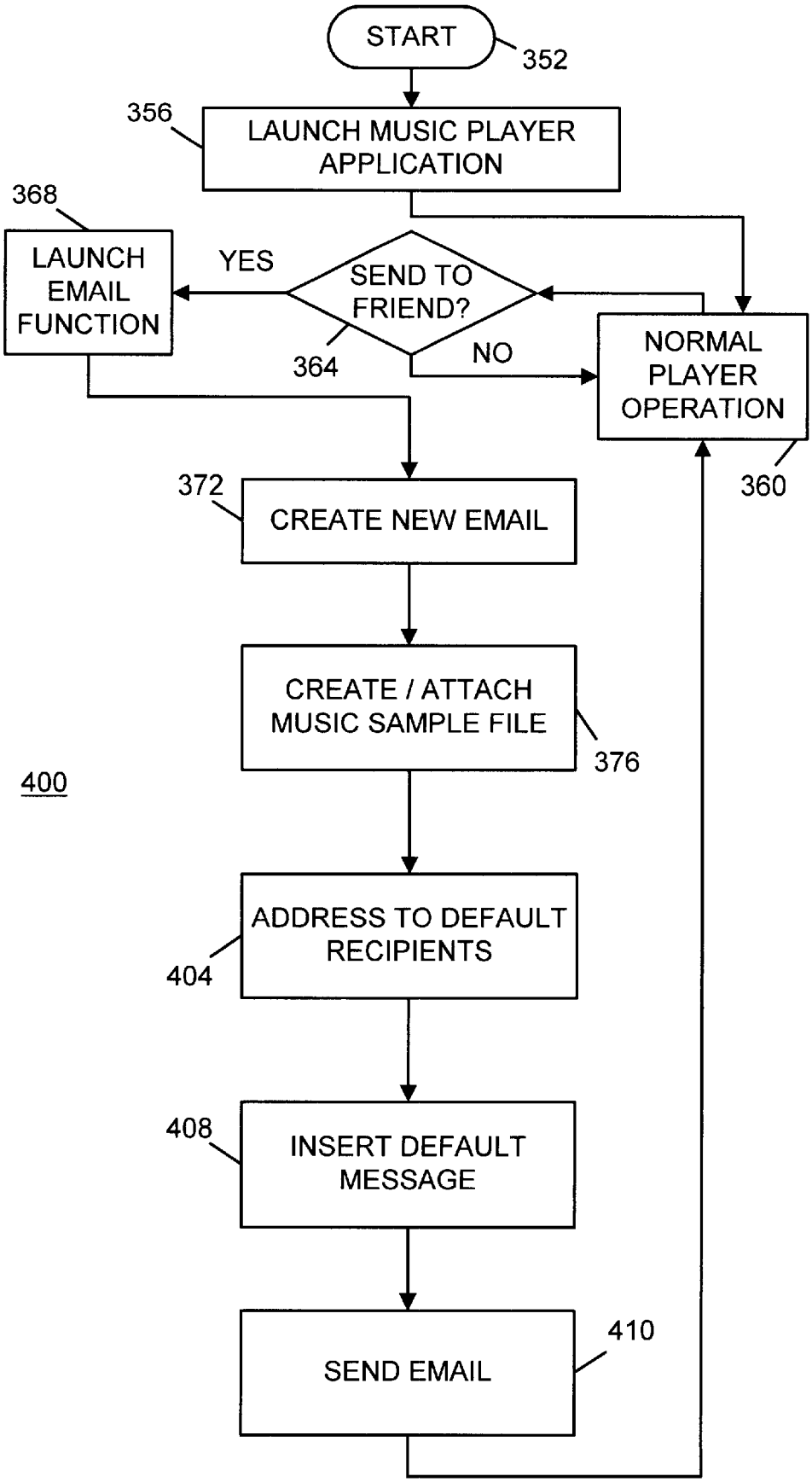
FIG. 10 is a flow chart illustrating another music clipping and distribution process consistent with certain embodiments of the present invention.

When the user has completed entering and editing the email message and recipients at 392, then the user elects to send the email by clicking a send button at 396 to cause the email to be sent at 398. Control then returns to 360 for normal media player operation. While FIG. 10 illustrates a sequential process wherein the normal media player operation is illustrated as a functional block that is separate and distinct from the process of sending the email, in preferred embodiments of the invention, the media player continues to play the music selection in the background while the creation of the email is carried out. This can be accomplished using various known techniques including buffering of the music and running the media player application as a background task. Other techniques can also be employed to permit the user to continue listening to music throughout the process described by 364 through 410 without departing from the invention. In other embodiments, the email can be created and buffered for later transmission when an email application is opened. Other variations will occur to those skilled in the art.

FIG. 10 illustrates a process 400 for carrying out a simplified process similar to that of process 350 of FIG. 9. However, in process 400, a single click of the "send to friend" icon 336 initiates the creation and/or attachment of the music sample file at 376. Control then passes to 404 where the email is addressed to one or more default recipients. A default message (e.g., "Here is a song sample I think you might like.") is inserted at 408 and the email is sent at 410 without any user intervention after clicking "send to friend". Of course, this presupposes that there has been an initial creation of default messages, default recipients, etc. In accordance with the embodiment of process 400, a predefined list of recipients automatically receives the music sample whenever the user clicks on the "send to friend" icon 336 with no further action required by the user. Those skilled in the art will recognize that numerous variations of this process are possible wherein, for example, a default message and recipient list is provided but the user is given the opportunity to edit them prior to actually sending the email. (For example, a window can be displayed giving the user, e.g., 5 seconds to click a button to change from defaults. Otherwise, the default message is sent to the default recipient along with the sample.) Moreover, process 350 and process 400 can be varied as to the order of the specific operations carried out without departing from the invention.

Figure 11:
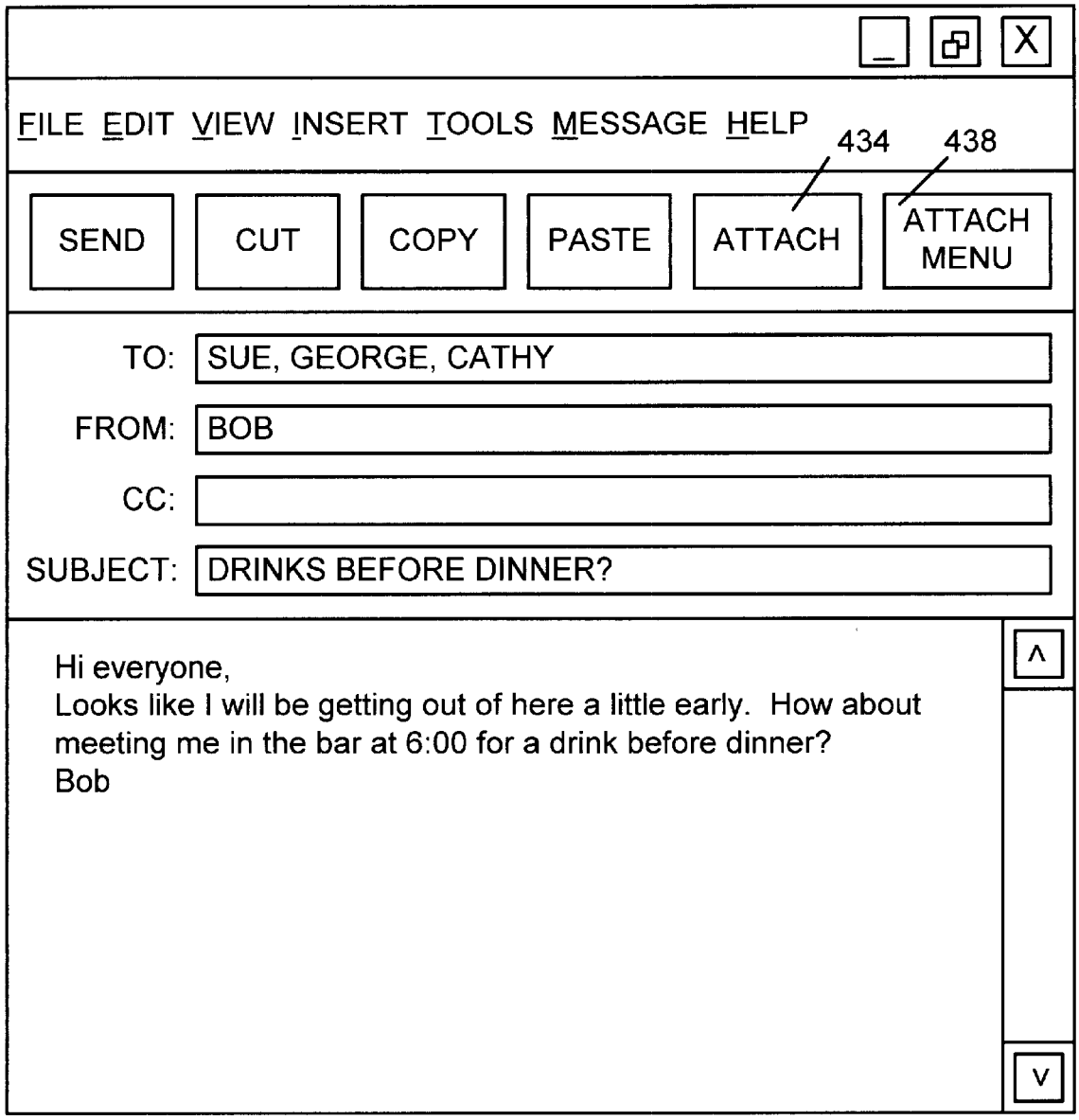
FIG. 11 illustrates an exemplary embodiment of a user interface of an electronic mail application consistent with certain embodiments of the present invention.

FIG. 11 illustrates another use for the music sample created as previously described within the context of conventional electronic mail. FIG. 11 shows a window used to create electronic mail message in an exemplary email software application. This exemplary user interface is similar to that used by numerous commercially available email applications and includes conventional addressing and editing functions as well as an "attach" icon 434 plus an "attach menu" icon 438. In this embodiment, the "attach" icon 434 is used to attach a default music sample and message to the current email The "attach menu" icon 438 is used to produce the default attachment and determine that it is to be sent to all emails or simply the emails selected using the "attach" icon 434.

Figure 12:
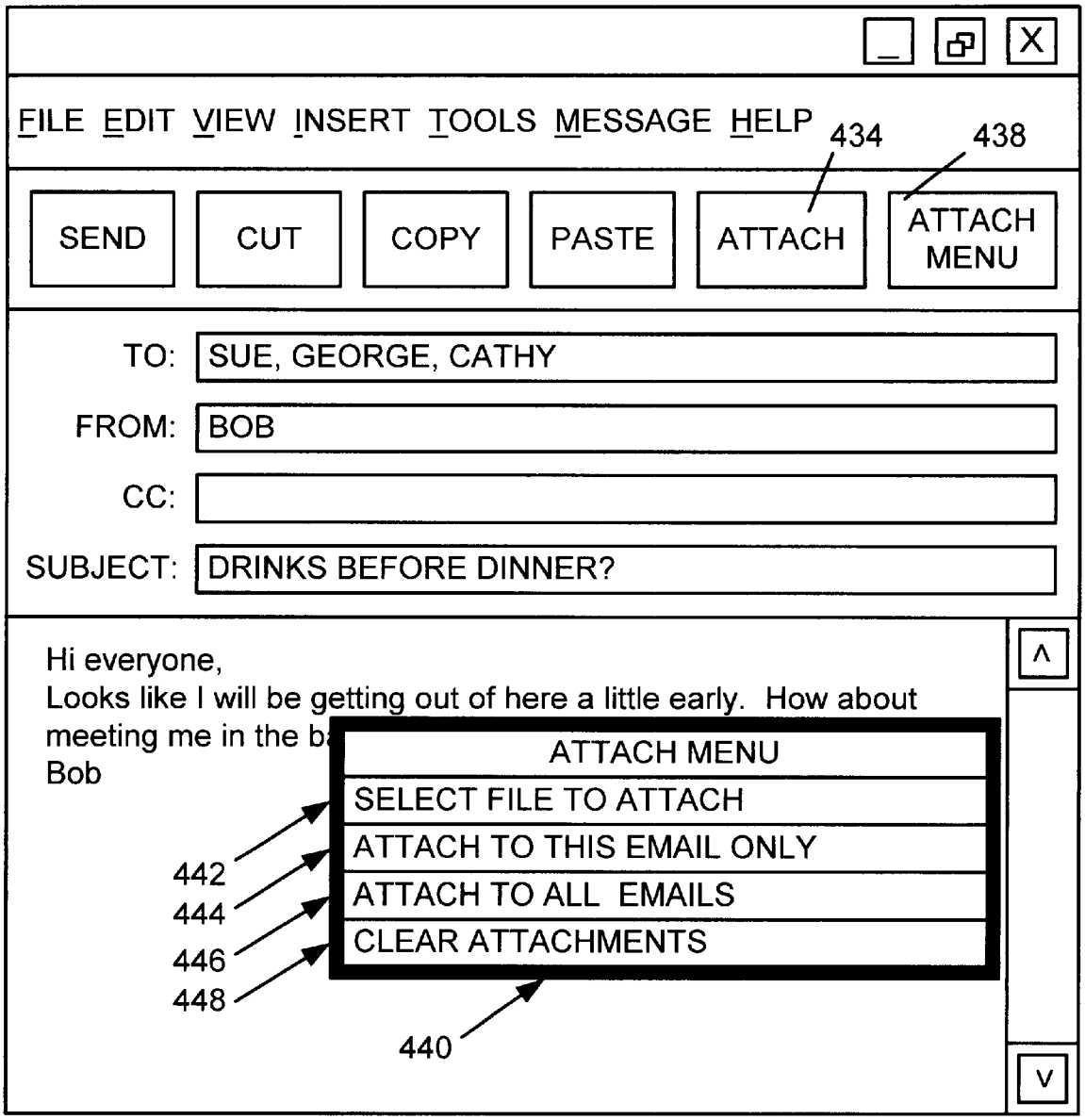
FIG. 12 illustrates an exemplary embodiment of a user interface of an electronic mail application showing an "Attach Menu" consistent with certain embodiments of the present invention.

Referring now to FIG. 12, "attach menu" icon 438 can be utilized to produce a drop down "attach" menu 440, and simplifies the process of attaching music sample files to an email message. In this embodiment, the drop down menu 440 permits the user to select a particular music file for attachment at 442 and provides the option of attaching the sample to a single email at 444 or to save the attachment as a default to be attached to all outgoing emails at 446 or whenever icon 434 is selected from within an email document. The "select file to attach" selection 442 can operate using a conventional browsing function as is commonly provided in Microsoft Windows compatible applications or using any other suitable mechanism. Selections 444 and 446 may provide access to a text editing function for providing a remark or comment to be attached as, for example, a footer to the email along with the sample file and further determines that the sample is attached to a single email or all emails. Whenever 444 or 446 is selected, the attachment created becomes the default attachment if so desired by the user (e.g., by checking a "default attachment" box in the attachment creation process) until cleared using selection 448. Whenever 446 is selected, the attachment including a music sample is attached to all emails sent out by the user until the selection is changed.

Figure 13:
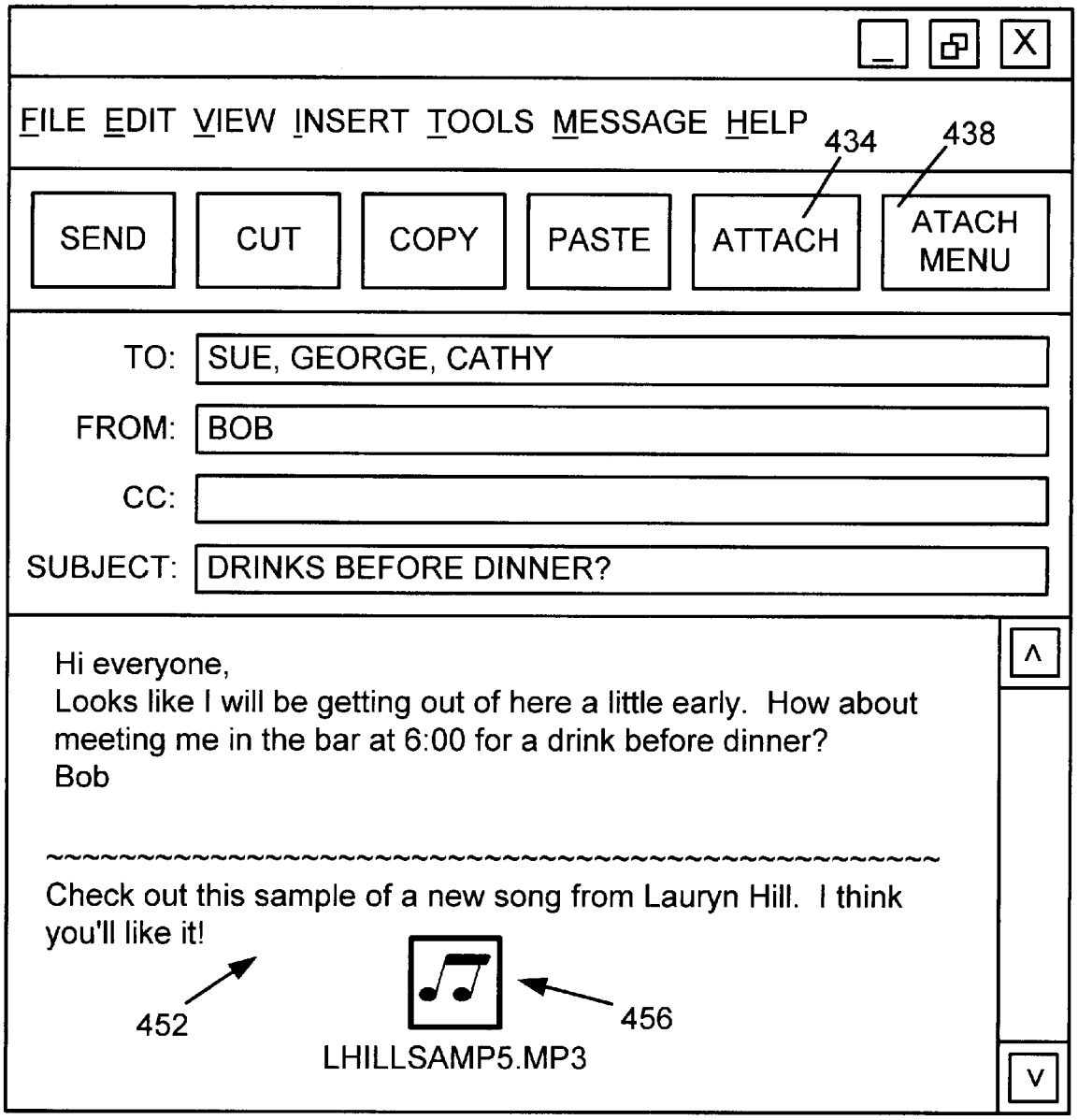
FIG. 13 illustrates an exemplary embodiment of a user interface of an electronic mail application showing an attached audio file consistent with certain embodiments of the present invention.

FIG. 13 illustrates a completed email message including a footer-like comment 452 regarding the music sample attachment and a music sample file illustrated as an icon 456 which the recipient of the email can click (e.g., with a mouse) in order to play or save the sample file.

Figure 14:
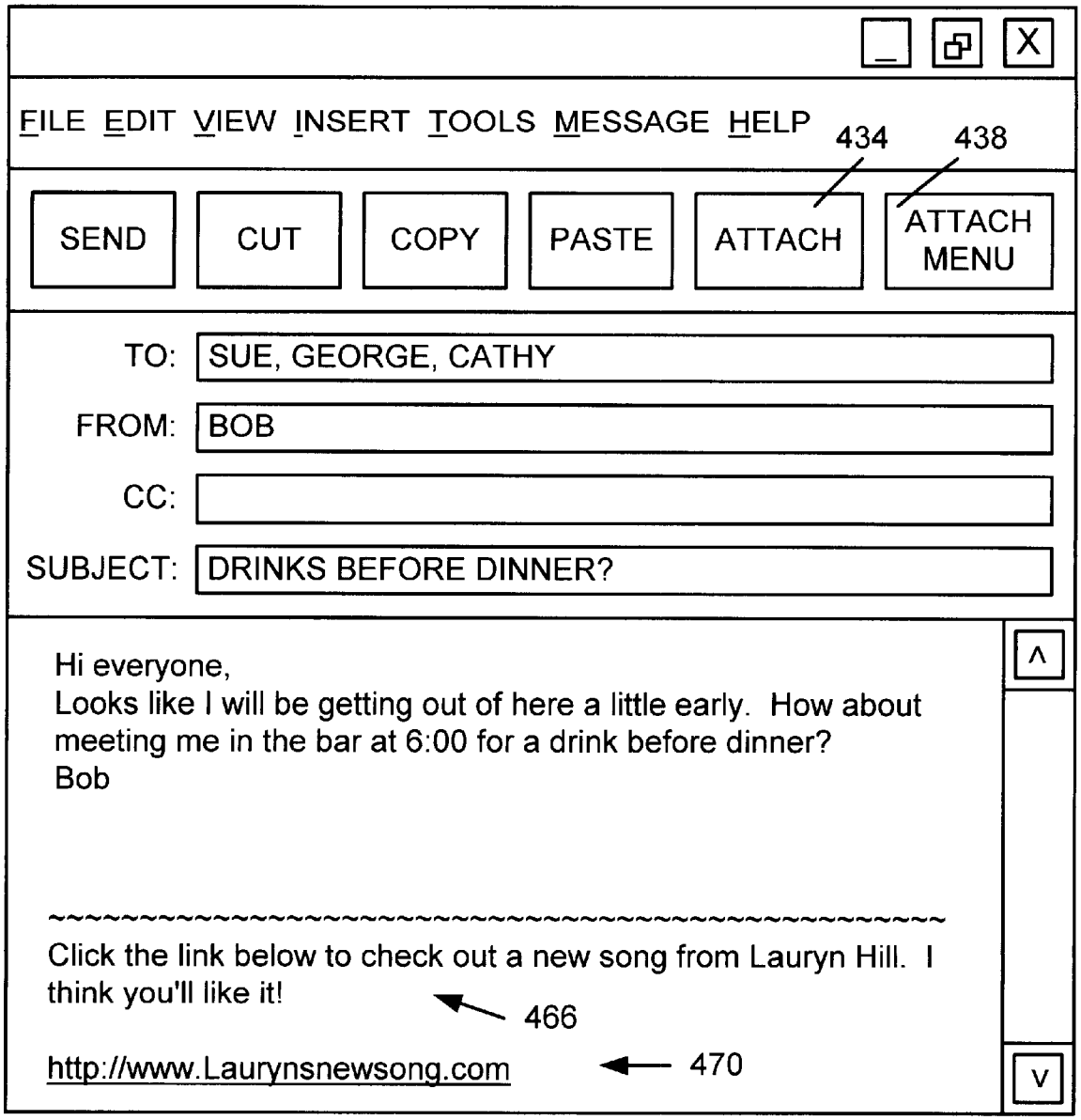
FIG. 14 illustrates an exemplary embodiment of a user interface of an electronic mail application showing an attached link to an audio sample consistent with certain embodiments of the present invention.

FIG. 14 illustrates another embodiment of a completed file in which rather than sending a sample file such as 456, the user is able to provide a footer including a text message 466 along with a Universal Resource Locator (URL) 470 that directs the recipient to a web site or web page on the Internet identified by URL 470. In this example, the URL 470 will, in one embodiment, provide the user with a streaming audio sample of the song desired. In this case, the song sample might be provided by a record company, record production company, retail music outlet, electronic retailer (e-tailer), etc. and may also provide the recipient with access to a purchase option and/or other information regarding the music selection being sampled.

Figure 15:
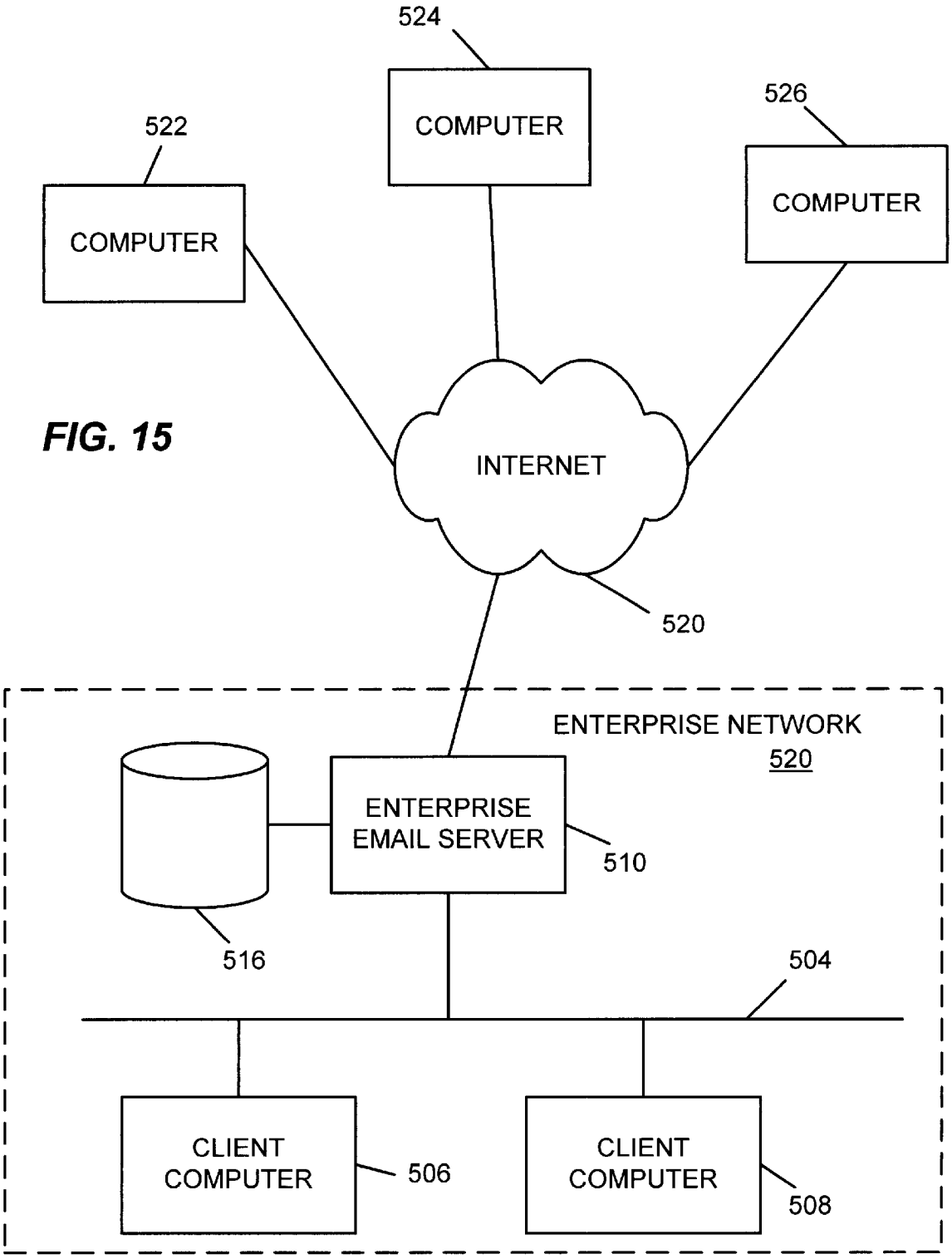
FIG. 15 is an exemplary system block diagram of an email system using an enterprise email server according to certain embodiments of the invention.

The format of email 430 described in connection with FIG. 14 is also conducive to an email music marketing arrangement as illustrated in FIG. 15. FIG. 15 illustrates an Enterprise network 500, which might represent a music company, retail establishment, e-tailer or other Enterprise with interests in promoting a particular recording. The Enterprise includes a network 502 of computers attached by some common local network and/or wide area network, wiring arrangement illustrated as 504. Attached to this network may be a plurality of client computers and servers shown as 506 and 508. In addition, the Enterprise utilizes an Enterprise email server 510 having an associated database 516. For Enterprise 500, all electronic mail passes through the Enterprise email server 510 and is then either routed back to internal computers for the target address or sent out over the Internet 520 or other suitable network to reach destination computers such as 522, 524 and 526. In accordance with this embodiment, if the Enterprise wishes to promote a particular artist, the Enterprise email server 510 can be utilized to attach a footer to each outgoing email message incorporating a music sample or URL to a particular music sample. In this manner, the Enterprise can capitalize upon hundreds or thousands of electronic email messages going out each day from the Enterprise to various recipients as a marketing tool to further promote a particular artist.

Figure 16:
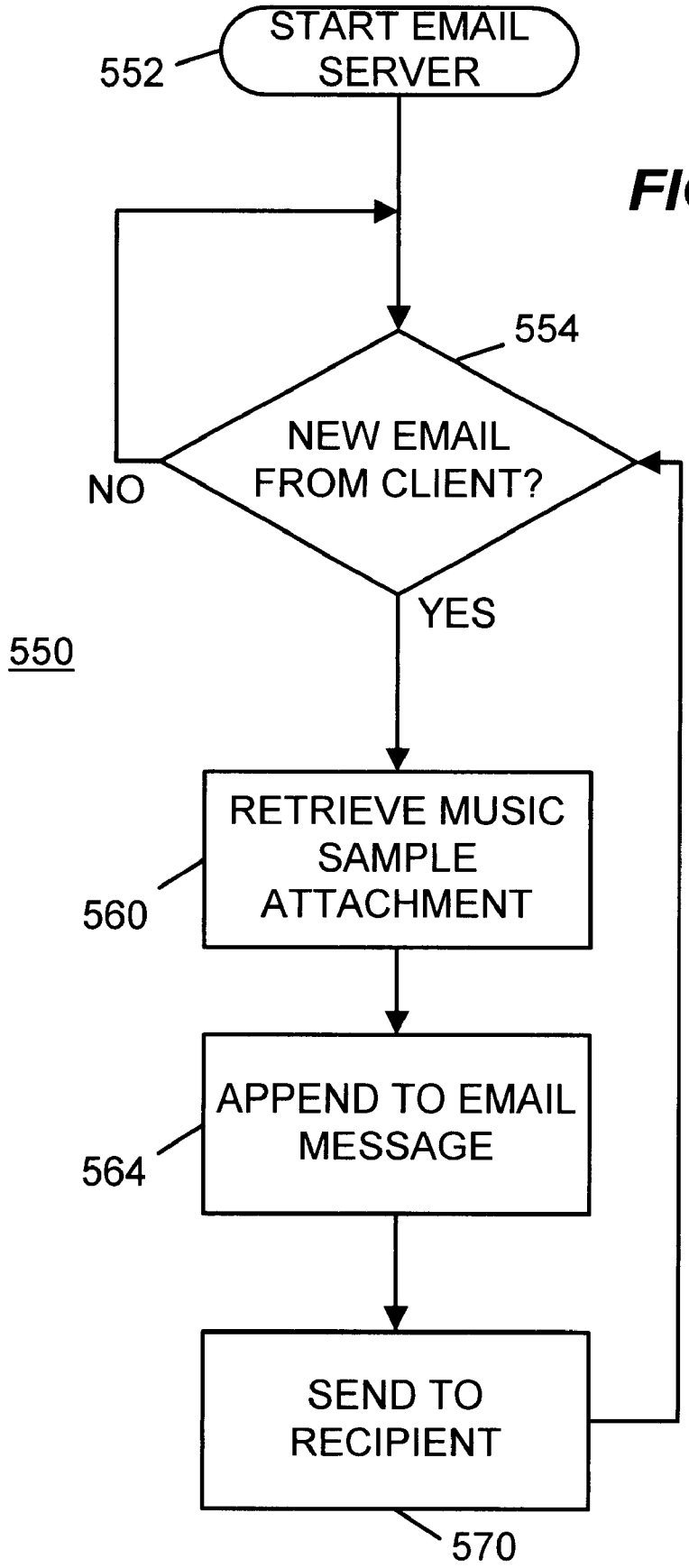
FIG. 16 is a flow chart illustrating the operation of the email server of FIG. 15 according to an embodiment of the present invention.

FIG. 16 illustrates a process 550 as just described wherein the email server is started at 552 and then awaits receipt of a new outgoing email from a client computer at 554. Once a new email message is received from a client computer for distribution either internally (if desired) or over Internet 520, a music sample attachment (or URL to a sample) is retrieved at 560 from the servers storage system 516. The email message is then appended to the email at 564 before forwarding the email to the recipient at 570. Thus, each email transmitted by the Enterprise can be used as a marketing tool for a particular artist. If desired, the particular song sample being sent can be varied randomly, in accordance with time or according to any other suitable scheme that fits the marketing strategy of the Enterprise.

In another embodiment consistent with the present invention, the general population can be enlisted as marketers for music marketing. Referring back to FIG. 14, an email message as illustrated can be used as a basis to accumulate affinity points (similar to frequent flyer miles or hotel club miles) for participating in promotion of a favorite artist. Consider, for example, that the sender (Bob) of email 430 signs up with a music marketing concern to help promote their music. By sending music samples out along with all of Bobs' email, he may generate interest in the song and album from which a particular sample is taken. In this case, Bob may, for example, register his own samples with the music marketing concern or may receive the samples periodically by email or from a web site, for example, from the marketing concern. A process such as that illustrated in FIG. 17 can then be used to accumulate "credits" for an affinity program associated with the music marketing concern. Such credits may, for example, provide the user with discounts, free merchandise or contest entries from the marketer to encourage the distribution of samples.

Process 600 starts at 602 after which the sender sends an email to a recipient with the email including a Universal Resource Locator to a music sample at 606. Upon receipt of this email, the recipient may use the URL at 610 to visit the site with the music sample and either receive a download of the music sample or receive the music sample as a streaming audio sample from the site at 614. The site also may provide a purchase option at 620 to the sample recipient as well as providing other information and/or offers. At 624, if the recipient decides to make a purchase, the sender may receive an affinity credit based upon the purchase at 630. The process ends at 634.

There are many ways of implementing the process just described. For example, the recipient may be required to supply the email address of the sender of the email in order for the recipient to receive a discount toward the purchase of the music selection or other purchases at the web site. This provides the merchant with the sender's identifying information so that the sender's account can be credited with affinity credits. In another embodiment, invoking the URL 470 actually invokes a Java applet which extracts the source of the email and forwards it to the web site in a manner transparent to the user as the user is directed to the web site to receive this streaming audio sample. Those skilled in the art will recognize that there are many other ways of implementing the present invention.

Figure 17:
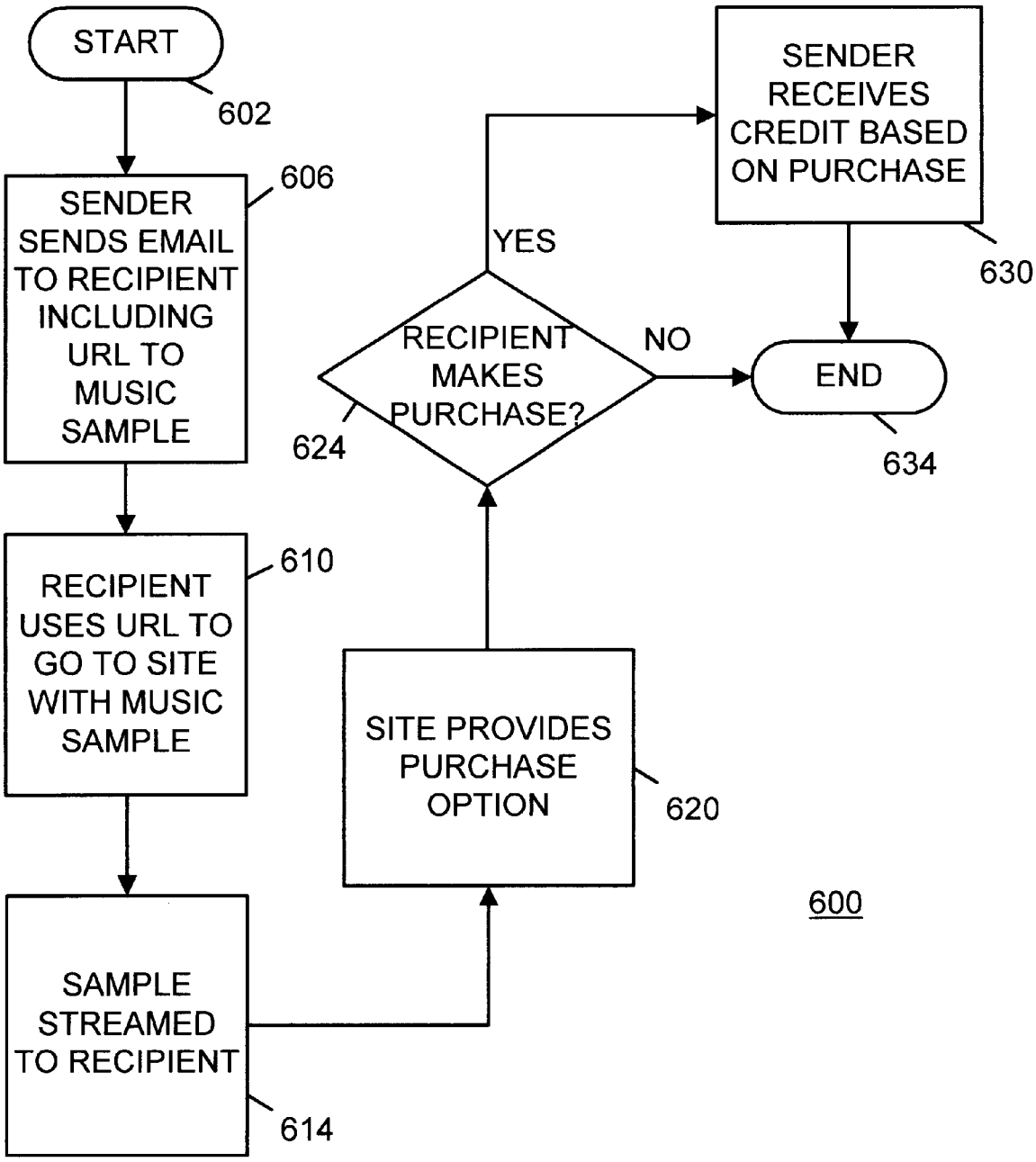
FIG. 17 is a flow chart illustrating a process for awarding affinity points consistent with certain embodiments of the present invention.
Figure 18:
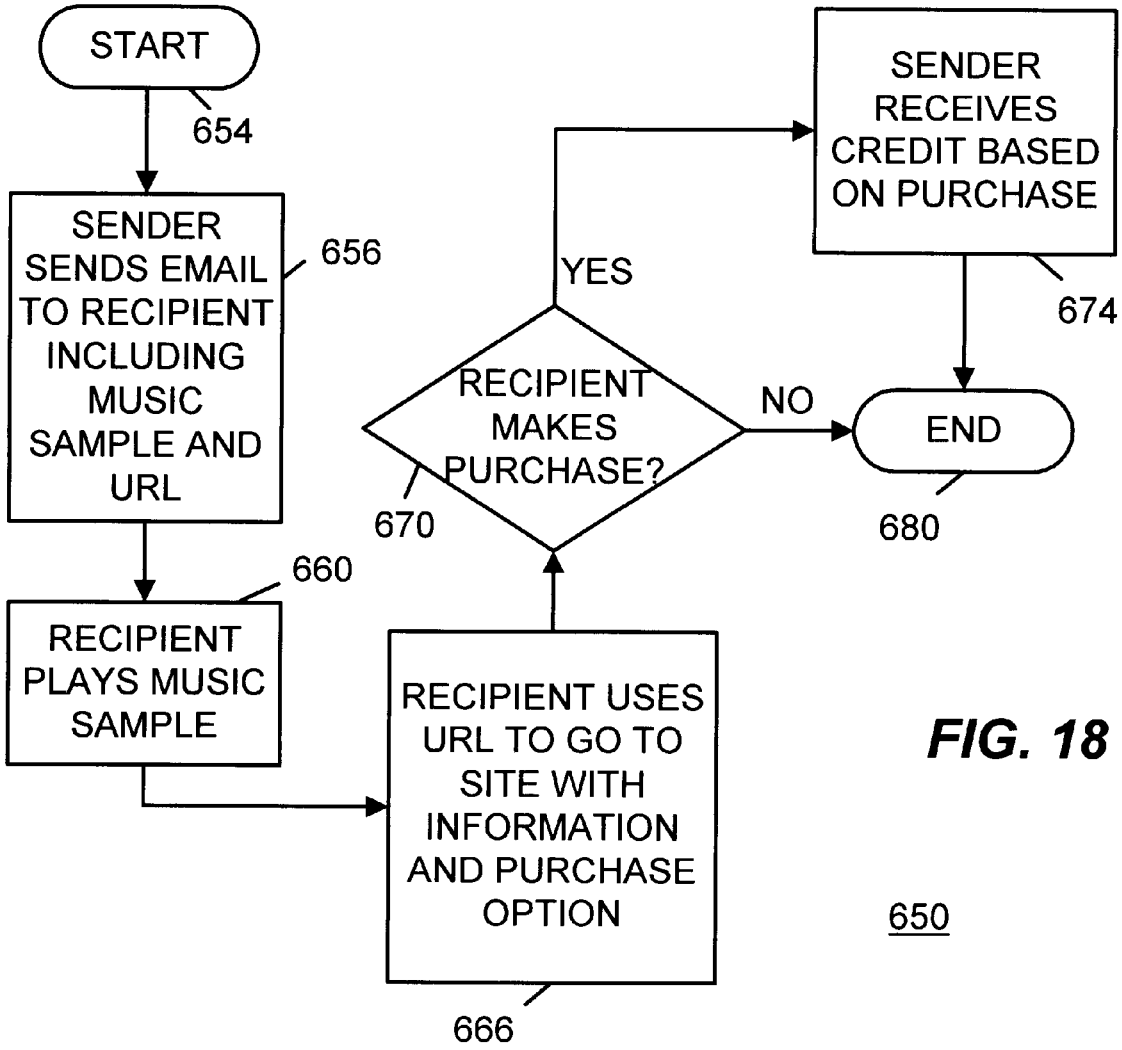
FIG. 18 is a flow chart illustrating another process for awarding affinity points consistent with certain embodiments of the present invention.
Figure 19:
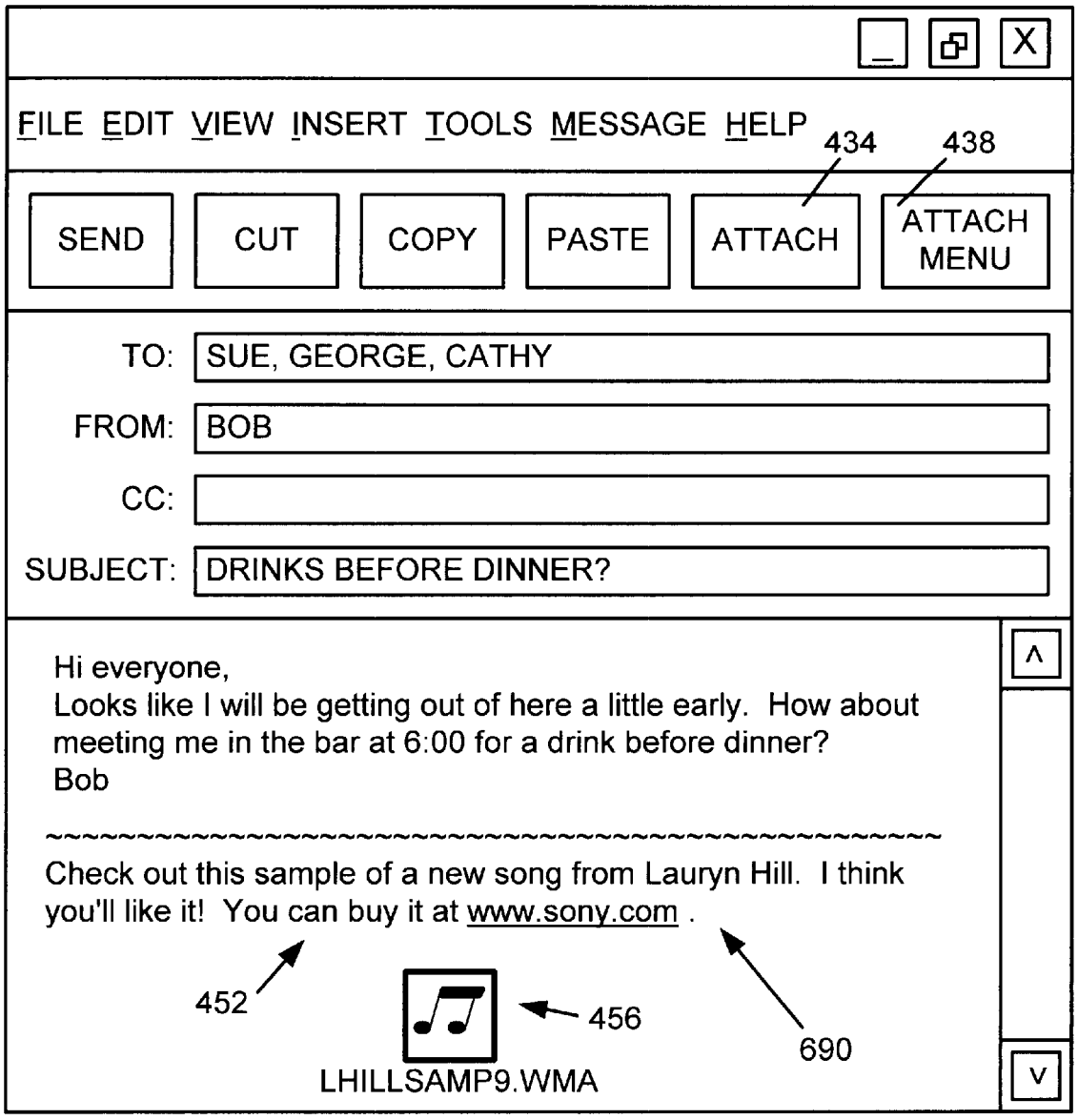
FIG. 19 illustrates an exemplary embodiment of a user interface of an electronic mail application showing an attached audio file and link to purchase options consistent with certain embodiments of the present invention.

FIG. 18 illustrates a variation of the embodiment shown in FIG. 17 as process 650 starting at 654. At 656 the sender sends an email to the recipient including an actual music sample plus a URL that directs the user to a web site wherein a full copy of the selection can be purchased. At 660 the recipient plays the music sample and at 666 the recipient uses the URL to separately go to a site with information and purchase options. Should the recipient make a purchase at 670, the sender receives credits from the site to his affinity account based upon the purchase at 674 and the process ends at 680. A sample email illustrating use of a URL as well as a music sample is illustrated in FIG. 19. In this illustration, the footer also includes remarks 452 as well as an icon 456 for accessing the music sample. In addition, the remarks include a link to a web site 690 where the user can make a purchase of the full selection.

The mechanics of an actual purchase, as well as the nature of the sample can be varied in many ways without departing from the present invention. For example, the sample may be a small part of a full file containing the entire music selection. In such an embodiment only a small portion of the file is readily available for play by the recipient. In order to make the purchase of the full version of the music selection; the user need not download a full copy since a full copy is already available. The user merely purchases a key used to decrypt the song. Numerous variations on this theme are also possible. For example, the entire file may be available for sampling in its entirety with an encryption function that only permits one play until it is decrypted after paying for the music.

Those skilled in the art will recognize that the present invention has been described in terms of exemplary embodiments based upon use of a programmed processor such as that residing in a personal computer or personal music player. However, the invention should not be so limited, since the present invention could be implemented using hardware component equivalents such as special purpose hardware and/or dedicated processors which are equivalents to the invention as described and claimed. Similarly, general purpose computers, microprocessor based computers, micro-controllers, optical computers, analog computers, dedicated processors and/or dedicated hard wired logic may be used to construct alternative equivalent embodiments of the present invention.

Those skilled in the art will appreciate that the program steps used to implement the embodiments described above can be implemented using disc storage as well as other forms of storage including Read Only Memory (ROM) devices, Random Access Memory (RAM) devices; optical storage elements, magnetic storage elements, magneto-optical storage elements, flash memory, core memory and/or other equivalent storage technologies without departing from the present invention. Such alternative storage devices should be considered equivalents.

The present invention is preferably implemented using a programmed processor executing programming instructions that are broadly described above in flow chart form and which can be stored in any suitable electronic storage medium. However, those skilled in the art will appreciate that the processes described above can be implemented in any number of variations and in many suitable programming languages without departing from the present invention. For example, the order of certain operations carried out can often be varied, and additional operations can be added without departing from the invention. Error trapping can be added and/or enhanced and variations can be made in user interface and information presentation without departing from the present invention. Such variations are contemplated and considered equivalent.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A method of transmitting an audio sample, comprising:

within a media player application program, playing an audio selection;

upon receipt of a command from a user, launching an email application from within the media player;

generating an email message;

attaching a sample of the audio selection to the email; and sending the email and the attached audio sample to a recipient.

2. The method according to claim 1, wherein the audio sample comprises a computer file containing a compressed audio sample.

3. The method according to claim 2, wherein the audio sample further comprises a link to a source for purchase of a product containing a representation of the audio sample.

4. The method according to claim 3, wherein if the recipient makes a purchase from the source, an affinity credit is awarded to the sender.

5. The method according to claim 1, wherein the audio sample comprises a link to a source of streaming audio.

6. The method according to claim 5, wherein the link further provides access to a source of purchase of a product containing a representation of the audio sample.

7. The method according to claim 6, wherein if the recipient makes a purchase from the source, an affinity credit is awarded to the sender.

8. The method according to claim 1, wherein a single command comprising clicking an icon generates the launching, generating, attaching and sending without further user commands.

9. The method according to claim 1, wherein the recipient is a default recipient.

10. The method according to claim 1, wherein the recipient is one of a plurality of potential recipients, and further comprising selecting the recipient from the plurality of potential recipients.

11. The method according to claim 1, further comprising creating the sample of the audio selection.

12. The method according to claim 11, wherein the creating comprises clipping a segment from the audio selection and compressing the clipping.

13. The method according to claim 12, wherein the clipping comprises:

selecting a starting point a predetermined time from the start of the audio selection as the start of the segment; and selecting a stopping point a predetermined time from the start of the segment.

14. The method according to claim 13, wherein the compressing comprises applying a fidelity reducing compression technique.

15. A media player, comprising:

a programmed processor;

a media player application running on the programmed processor to enable a user to play content;

a user interface for the media player;

an icon, forming a part of the user interface, that when selected causes the media player application to launch an email application and send a sample of the content from a sender to a recipient.

16. The media player according to claim 15, wherein upon selection of the icon, the media player launches an email application, generates an email message, attaches a sample of the content to the email, and sends the email and the attached content sample to the recipient.

17. The media player according to claim 15, wherein the content sample comprises a computer file containing a compressed music sample.

18. The media player according to claim 15, wherein the content sample further comprises a link to a source for purchase of a product containing a representation of the content sample.

19. The media player according to claim 18, wherein if the recipient makes a purchase from the source, an affinity credit is awarded to the sender.

20. The media player according to claim 15, wherein the content sample comprises a link to a source of streaming music.

21. The media player according to claim 20, wherein the link further provides access to a source of purchase of a product containing a representation of the content sample.

22. The media player according to claim 21, wherein if the recipient makes a purchase from the source, an affinity credit is awarded to the sender.

23. The media player according to claim 15, wherein a single command comprising clicking an icon generates the launching and sending without further user commands.

24. The media player according to claim 15, wherein the recipient is a default recipient.

25. The media player according to claim 15, wherein the recipient is one of a plurality of potential recipients, and further comprising means for selecting the recipient from the plurality of potential recipients.

26. The media player according to claim 15, wherein the content comprises a music selection further comprising means for creating the sample of the content.

27. The media player according to claim 26, wherein the creating means comprises means for clipping a segment from the music selection and means for compressing the clipping.

28. The media player according to claim 27, wherein the means for clipping comprises:

means for selecting a starting point a predetermined time from the start of the music selection as the start of the segment; and means for selecting a stopping point a predetermined time from the start of the segment.

29. The media player according to claim 27, wherein the means for compressing comprises means for applying a fidelity reducing compression technique.

30. A media player, comprising:

a programmed processor;

a media player application running on the programmed processor to enable a user to play a music selection;

a user interface for the media player;

an icon, forming a part of the user interface, that when selected causes the media player application to launch an email application, generate an email message, create a sample of the music selection, attach the sample of the music selection to the email, and send the email and the attached music sample to a selected recipient;

wherein the selected recipient is a recipient selected from a plurality of potential recipients;

wherein, the music sample comprises a computer file containing a compressed music sample and a link to a source for purchase of a product containing a representation of the music sample;

wherein the sample is created by:

selecting a starting point a predetermined time from the start of the music selection as the start of the segment, selecting a stopping point a predetermined time from the start of the segment, and compressing data between starting point and the stopping point using by applying a fidelity reducing compression technique; and wherein if the recipient makes a purchase from the source, an affinity credit is awarded to the sender.

31. An electronic storage medium containing instructions which, when executed on a programmed processor, carry out a method of transmitting a content sample from within the media player, comprising:

playing a content selection;

upon receipt of a command from a user, launching an email application from within the media player;

generating an email message;

attaching a sample of the content selection to the email; and sending the email and the attached content sample to a recipient.

32. The electronic storage medium according to claim 31, wherein the content comprises music and wherein the content sample comprises a computer file containing a compressed music sample.

33. The electronic storage medium according to claim 32, wherein the music sample further comprises a link to a source for purchase of a product containing a representation of the music sample.

34. The electronic storage medium according to claim 31, wherein the content comprises music and wherein the content sample comprises a link to a source of streaming music.

35. The electronic storage medium according to claim 31, wherein a single command comprising clicking an icon generates the launching, generating, attaching and sending without further user commands.

36. The electronic storage medium according to claim 31, wherein the recipient is a default recipient.

37. The electronic storage medium according to claim 31, wherein the recipient is one of a plurality of potential recipients, and further comprising selecting the recipient from the plurality of potential recipients.

38. The electronic storage medium according to claim 31, wherein the content comprises a music selection and further comprising creating the sample of the music selection.

39. The electronic storage medium according to claim 38, wherein the creating comprises clipping a segment from the music selection and compressing the clipping.

40. The electronic storage medium according to claim 39, wherein the clipping comprises:

selecting a starting point a predetermined time from the start of the music selection as the start of the segment; and selecting a stopping point a predetermined time from the start of the segment.

41. The electronic storage medium according to claim 40, wherein the compressing comprises applying a fidelity reducing compression technique.

* * * * *